US008393496B2

(12) United States Patent
Bandoh et al.

(10) Patent No.: US 8,393,496 B2
(45) Date of Patent: Mar. 12, 2013

(54) STACK OF SHEETS AND SHEET CONTAINER

(75) Inventors: Takeshi Bandoh, Kagawa-ken (JP); Koji Sangawa, Kagawa-ken (JP)

(73) Assignee: Uni-Charm Corporation, Ehime (JP)

( * ) Notice: Subject to any disclaimer, the term of this patent is extended or adjusted under 35 U.S.C. 154(b) by 107 days.

(21) Appl. No.: 12/935,305

(22) PCT Filed: Mar. 30, 2009

(86) PCT No.: PCT/JP2009/056522

§ 371 (c)(1),
(2), (4) Date: Dec. 13, 2010

(87) PCT Pub. No.: WO2009/123131

PCT Pub. Date: Oct. 8, 2009

(65) Prior Publication Data

US 2011/0101592 A1 May 5, 2011

(30) Foreign Application Priority Data

Mar. 31, 2008 (JP) ..... 2008-094290

(51) Int. Cl.
*A47K 10/24* (2006.01)

(52) U.S. Cl. ..... 221/48; 221/50; 221/33; 221/45; 428/126; 428/130; 206/812; 206/449; 206/554

(58) Field of Classification Search ..... 221/45, 221/46, 47, 48, 50, 33; 428/126, 130; 206/812, 206/449, 494, 554, 459
See application file for complete search history.

(56) References Cited

U.S. PATENT DOCUMENTS

| | | | | |
|---|---|---|---|---|
| 3,207,360 | A * | 9/1965 | Scott | 221/48 |
| 5,497,903 | A * | 3/1996 | Yoneyama | 221/48 |
| 5,565,258 | A * | 10/1996 | McConnell et al. | 428/122 |
| 5,853,845 | A * | 12/1998 | McConnell et al. | 428/126 |
| 6,213,344 | B1 * | 4/2001 | Hill | 221/38 |
| 6,250,495 | B1 * | 6/2001 | Bando | 221/48 |

(Continued)

FOREIGN PATENT DOCUMENTS

| | | |
|---|---|---|
| EP | 0879575 | 11/1998 |
| EP | 1195333 | 4/2002 |

(Continued)

OTHER PUBLICATIONS

ISR for PCT/JP2009/056522 mailed Jun. 9, 2009.

(Continued)

*Primary Examiner* — Patrick Mackey
(74) *Attorney, Agent, or Firm* — Lowe Hauptman Ham & Berner, LLP

(57) ABSTRACT

A representative stack of sheets including sheet bodies each of which is formed by folding a sheet and has a plurality of pieces between both ends of the sheet body. The sheet bodies are stacked one on another in such a manner that one of the plurality of pieces of each of the sheet bodies on one side in a stacking direction and another piece on the other side are inserted between pieces of an adjacent sheet body on one side in the stacking direction with respect to the sheet body and between pieces of an adjacent sheet body on the other side in the stacking direction, respectively, wherein an auxiliary piece is formed by folding an end of the piece of the sheet body.

20 Claims, 8 Drawing Sheets

U.S. PATENT DOCUMENTS

| | | | | |
|---|---|---|---|---|
| 6,543,643 | B2 * | 4/2003 | Iida et al. | 221/48 |
| 6,685,050 | B2 * | 2/2004 | Schmidt et al. | 221/48 |
| 8,097,326 | B2 * | 1/2012 | Wunderlich | 428/126 |

FOREIGN PATENT DOCUMENTS

| | | | |
|---|---|---|---|
| JP | 06023774 | A | 2/1994 |
| JP | 07213453 | A | 8/1995 |
| JP | 2000051118 | A | 2/2000 |
| JP | 2002102106 | A | 4/2002 |
| JP | 2005287610 | A | 10/2005 |
| JP | 2007159880 | A | 6/2007 |

OTHER PUBLICATIONS

International Preliminary Report an Patentability for PCT/JP2009/056522.

Extended European Search Report for Application No. 09728963.1 dated Jun. 28, 2012.

* cited by examiner

STACK OF SHEETS AND SHEET CONTAINER

RELATED APPLICATIONS

The present application is national phase of International Application Number PCT/JP2009/056522 filed Mar. 30, 2009, and claims priority from, Japanese Application Number 2008-094290 filed Mar. 31, 2008.

BACKGROUND OF THE INVENTION

1. Field of the Invention

The invention relates to a technique of forming a stack of sheets by stacking a plurality of sheets one on another.

2. Description of the Related Art

Various kinds of sheets such as wet tissues are used to remove dirt on skin. For example, Japanese non-examined laid-open Patent Publication No. H06-23774 discloses a sheet container including a stack of sheets formed by folding wet tissues and a sheet container for containing the stack of sheets.

SUMMARY OF THE INVENTION

Generally, sheets are stacked one on another while partly overlapping one another (being partly wrapped one around another). Thus, when the uppermost sheet of the stack of sheets is taken out through a take-out opening of a case, a sheet (to be taken out next) immediately underlying the sheet is partly exposed from the take-out opening by friction between the uppermost sheet and the underlying sheet. Therefore, sheets can be continuously taken out one by one. Friction between sheets depends on the material of the sheets and the contact area between the sheets.

Wet tissues are used in the impregnated state (wet state) with impregnating liquid, so that high friction is caused between the sheets. With the high friction between the sheets, when the uppermost sheet is taken out through the take-out opening of the case, not only part of the immediately underlying sheet to be taken out next, but part of the next sheet but one may be exposed from the take-out opening.

In order to prevent a plurality of sheets from being partly exposed through the take-out opening of the case, a method for reducing an overlapping region (contact area) between the sheets is conceivable. The contact area between the sheets can be easily reduced by adjusting the overlapping width (wrap-around width) of an overlap between the sheets. In the above-described known stack of sheets, however, in order to reduce the overlapping width of the overlap between the sheets, adjacent sheets to be stacked one on another must be displaced away from each other in the direction of the width. In this case, the width of the stack of sheets and thus the width of the sheet container are increased, so that the usability is impaired.

It is, accordingly, an object of the invention to provide a technique for reducing the contact area between adjacent sheets to be stacked one on another without increasing the width of a stack of sheets.

One aspect of the invention relates to a stack of sheets which is formed by stacking sheet bodies one on another, each of which is formed by folding a sheet and has a plurality of pieces. The sheet body is typically formed by folding a rectangular or square sheet. This invention particularly relates to a stack of sheets in which the sheet bodies are stacked one on another in such a manner that one of the pieces of each sheet body on one side in a stacking direction and another piece on the other side are inserted between pieces of an adjacent sheet body on one side in the stacking direction with respect to the sheet body and between pieces of an adjacent sheet body on the other side in the stacking direction, respectively. In order to insert a piece on one side and a piece on the other side of the sheet body in the stacking direction between pieces of an adjacent sheet body on one side in the stacking direction with respect to the sheet body and between pieces of an adjacent sheet body on the other side, respectively, various manners can be used in which the sheet bodies can be continuously taken out one by one. This invention can be applied to various sheets, and particularly suitably to sheets having high friction between the sheets, such as wet tissues. Further, an auxiliary piece is formed by folding an end of the piece of the sheet bodies which lies on one of the opposite sides in the stacking direction. The position and shape of the auxiliary piece can be appropriately selected such that the area of an overlapping region between adjacent sheets can be reduced by provision of the auxiliary piece.

In this invention, the overlapping width of the overlapping region between adjacent sheet bodies can be adjusted by adjusting the length of the auxiliary piece. In this manner, friction between adjacent sheet bodies can be reduced to an appropriate value, so that the sheet bodies can be taken out with stability. The technique of the invention is effective in stacking sheets having a width more than twice as large as the width of the stack of sheets.

Another aspect of this invention relates to a stack of sheets which is formed by stacking first and second sheet bodies one on another, each of which is formed by folding a sheet. The sheets are typically rectangular or square. Each of the first sheet bodies has a first piece, a second piece and a third piece between both ends of the sheet body, and the first piece and the third piece are folded in opposite directions to each other with respect to the second piece. The first sheet body typically comprises a Z-shaped sheet body as viewed from the direction of the width (the direction perpendicular to the folding lines). Further, each of the second sheet bodies has a fourth piece and a fifth piece between both ends of the sheet body. The second sheet body typically comprises a V-shaped sheet body as viewed from the direction of the width (the direction perpendicular to the folding lines). The first sheet bodies and the second sheet bodies are alternately stacked one on another in such a manner that the fourth piece and the fifth piece of each of the second sheet bodies are inserted between the second piece and the third piece of a first sheet body adjacent to the second sheet body on one side in a stacking direction and between the first piece and the second piece of a first sheet body adjacent to the second sheet body on the other side in the stacking direction, respectively. The first sheet bodies and the second sheet bodies are stacked one on another in various manners in which the first and second sheet bodies can be continuously taken out one by one from an end of one side (the take-out opening side) of the stack of sheets. Further, an auxiliary piece is formed by folding an end of the piece of each of the first and second sheet bodies which lies on one of the opposite sides in the stacking direction. The position and shape of the auxiliary piece can be appropriately selected such that an overlapping region between adjacent sheet bodies can be reduced by provision of the auxiliary piece.

In this invention, the overlapping width of the overlapping region between adjacent sheet bodies can be adjusted by adjusting the length of the auxiliary piece. In this manner, friction between adjacent sheet bodies can be reduced to an appropriate value, so that the sheet bodies can be taken out with stability. This technique is particularly effective in stacking sheets having a width more than twice as large as the width of the stack of sheets.

In another embodiment according to this invention, the auxiliary pieces of the first sheet bodies or second sheet bodies which are adjacent in the stacking direction do not overlap one another in the stacking direction. The construction in which "the auxiliary pieces do not overlap one another in the stacking direction" represents the construction in which a line extending from one of the auxiliary pieces along the stacking direction does not cross the other auxiliary piece. In order to provide a construction in which the auxiliary pieces of the first sheet bodies or second sheet bodies which are adjacent in the stacking direction do not overlap one another in the stacking direction, for example, the shape of the first or second sheet bodies, or the position or shape (width) of the auxiliary pieces may be adjusted.

In this embodiment, with the construction in which the auxiliary pieces of the first sheet bodies or second sheet bodies which are adjacent in the stacking direction do not overlap one another in the stacking direction, the stack of sheets can be prevented from being partially increased in height.

In a further embodiment according to this invention, the auxiliary pieces of the sheet bodies adjacent in the stacking direction do not overlap one another in the stacking direction. For example, an auxiliary piece of a first sheet body and an auxiliary piece of a second sheet body adjacent to the first sheet body do not overlap one another in the stacking direction. In order to provide a construction in which the auxiliary pieces of the sheet bodies adjacent in the stacking direction do not overlap one another in the stacking direction, for example, the shape of the first and second sheet bodies, or the position or shape (width) of the auxiliary pieces may be adjusted.

In this embodiment, with the construction in which the auxiliary pieces of the sheet bodies adjacent in the stacking direction do not overlap one another in the stacking direction, the stack of sheets can be more effectively prevented from being partially increased in height. Preferably, it may be constructed such that an auxiliary piece of a first sheet body and an auxiliary piece of a second sheet body which are adjacent in the stacking direction do not overlap one another in the stacking direction, such that auxiliary pieces of first sheet bodies which are adjacent in the stacking direction do not overlap one another in the stacking direction, and such that auxiliary pieces of second sheet bodies which are adjacent in the stacking direction do not overlap one another in the stacking direction.

A further aspect of the invention relates to a stack of sheets which is formed by stacking sheet bodies one on another, each of which is formed by folding a sheet. The sheets are typically rectangular or square. Each of the sheet bodies is formed by folding a sheet and has a first piece, a second piece and a third piece. The first piece and the third piece are folded in opposite directions to each other with respect to the second piece. The first sheet body typically comprises a Z-shaped sheet body as viewed from the direction of the width (the direction perpendicular to the folding lines). The sheet bodies are alternately stacked one on another in such a manner that the first piece and the third piece of each of the sheet bodies are inserted between the second piece and the third piece of a sheet body adjacent to the sheet body on one side in a stacking direction and between the first piece and the second piece of a sheet body adjacent to the sheet body on the other side in the stacking direction, respectively. The sheet bodies are stacked one on another in various manners in which the sheet bodies can be continuously taken out one by one from an end of one side of the stack of sheets. Further, an auxiliary piece is formed by folding an end of the piece of the sheet body which lies on one of the opposite sides in the stacking direction. The position and shape of the auxiliary piece can be appropriately selected such that the area of an overlapping region between adjacent sheet bodies can be reduced by provision of the auxiliary piece.

In this invention, the overlapping width of the overlapping region between adjacent sheet bodies can be adjusted by adjusting the length of the auxiliary piece. In this manner, friction between adjacent sheet bodies can be reduced to an appropriate value, so that the sheet bodies can be taken out with stability. This technique is particularly effective in stacking sheets having a width more than twice as large as the width of the stack of sheets.

In a further embodiment according to this invention, wet tissues are used as the sheets. In this embodiment, wet tissues can be suitably stacked one on another.

A further invention relates to a sheet container which includes a case with a take-out opening and a stack of sheets which is formed by stacking a plurality of sheets one on another and contained within the case, and from which sheets forming the stack of sheets are taken out one by one through the take-out opening of the case. In this invention, any one of the above-described stacks of sheets is used as the stack of sheets.

In this invention, the sheet container from which sheets can be taken out with stability can be obtained.

As a result, according to the invention, sheets can be taken out with stability without increasing the width of a stack of sheets.

DETAILED DESCRIPTION OF THE INVENTION (First Representative Embodiment)

Figure 1:
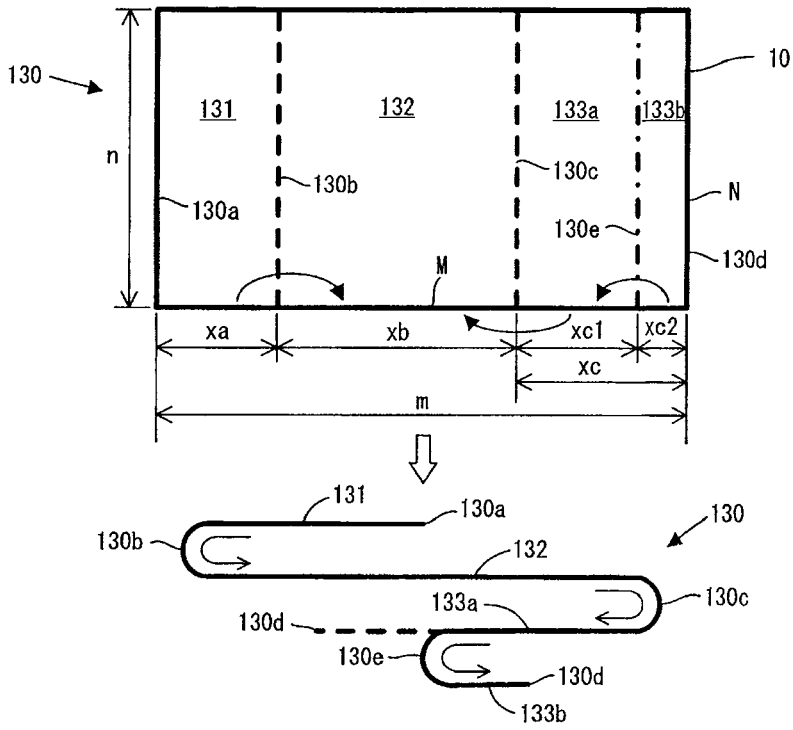
FIG. 1 shows a first sheet body forming a stack of sheets according to a first embodiment of the invention.
Figure 2:
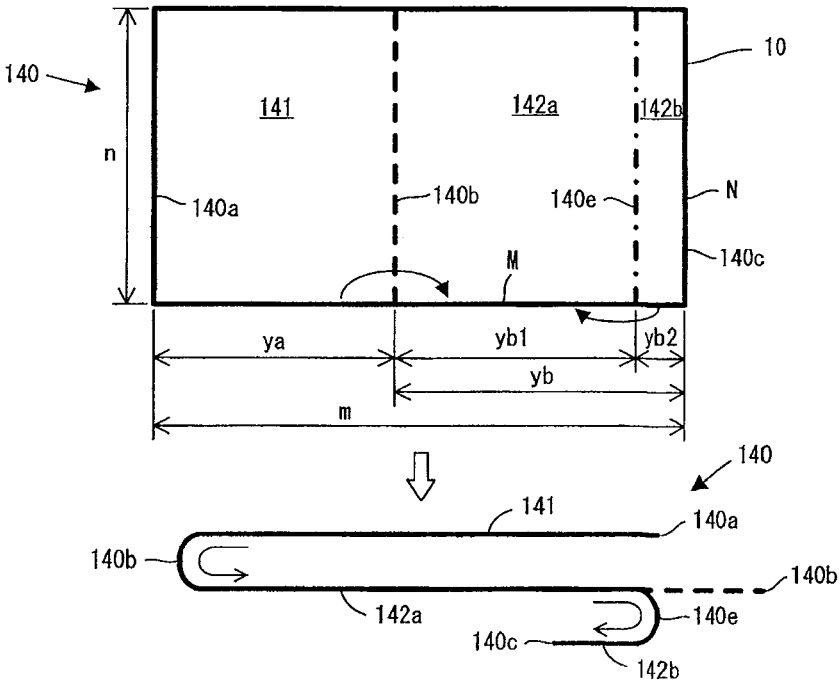
FIG. 2 shows a second sheet body forming the stack of sheets according to the first embodiment.
Figure 3:
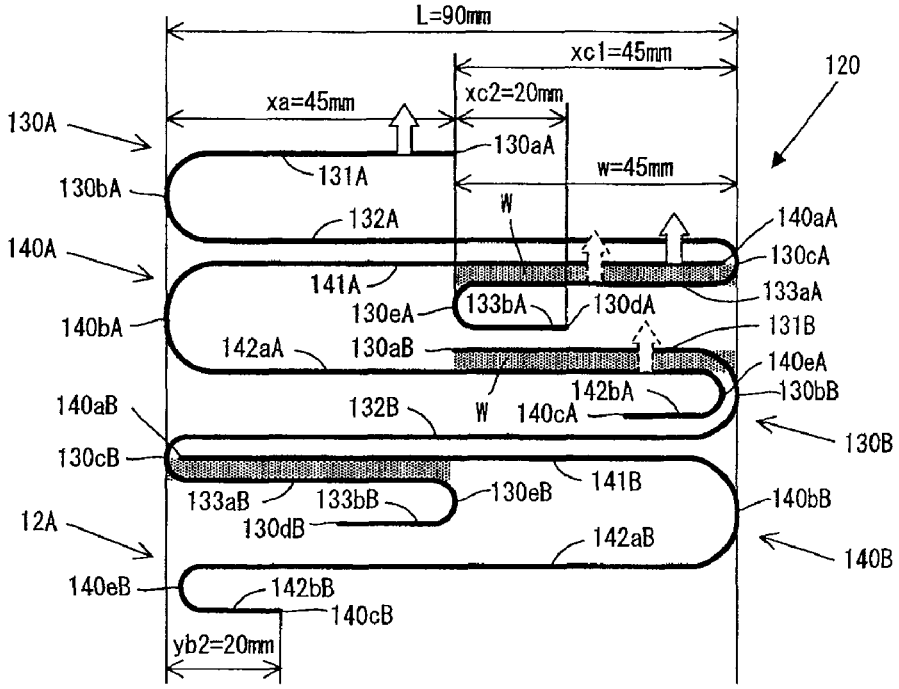
FIG. 3 shows one example of the stack of sheets according to the first embodiment, as viewed from the direction perpendicular to folding lines of the first and second sheet bodies (the direction of the width of the stack of sheets).
Figure 4:
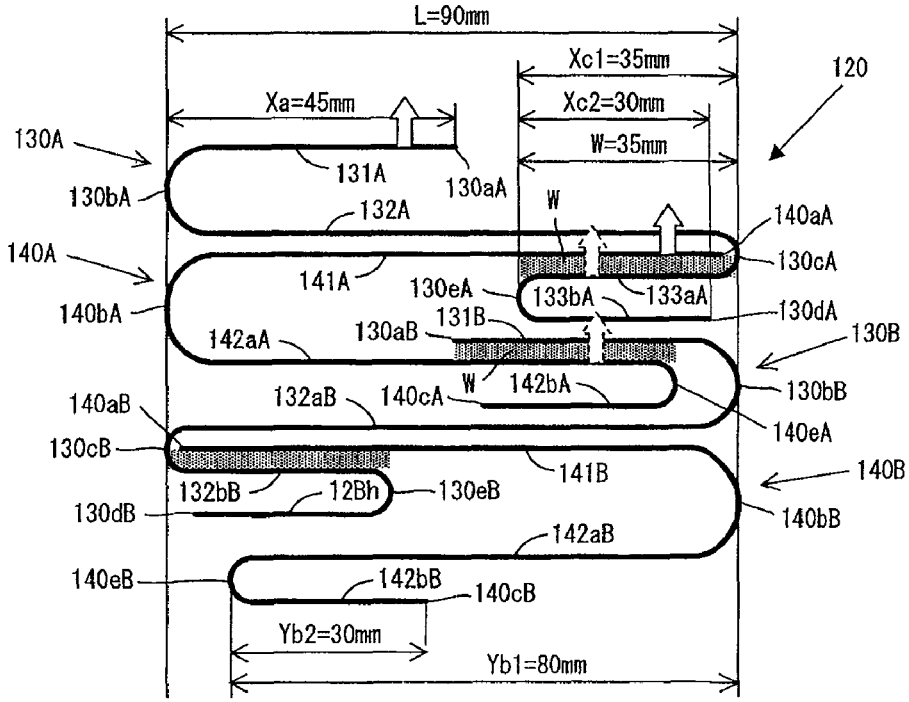
FIG. 4 shows another example of the stack of sheets according to the first embodiment, as viewed from the direction perpendicular to folding lines of the first and second sheet bodies (the direction of the width of the stack of sheets).
Figure 5:
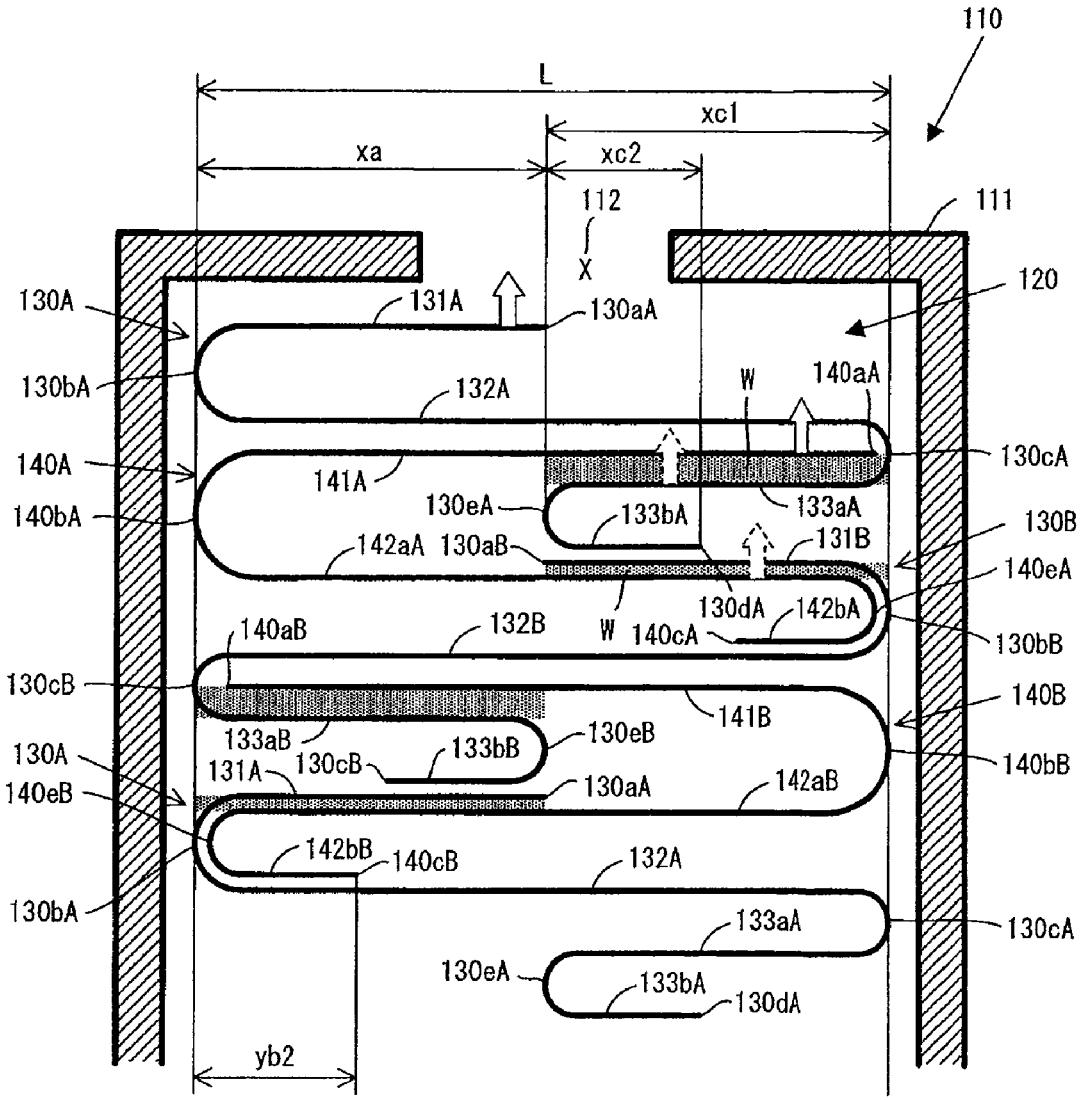
FIG. 5 shows a sheet container which contains the stack of sheets shown as the one example according to the first embodiment in a case.

First representative embodiment of the invention is now described with reference to FIGS. 1 to 5. In this embodiment, a stack of wet tissues is described as a representative example of a stack of sheets according to this invention. FIGS. 1 and 2 show a first sheet body 130 and a second sheet body 140, respectively, which form a stack of sheets 120 according to this embodiment, as viewed from a direction of the width (a direction perpendicular to folding lines). FIGS. 3 and 4 show two different examples of the stack of sheets 120 according to this embodiment, respectively, as viewed from the direction of the width (the direction perpendicular to folding lines). FIG. 5 shows a sheet container 110 which contains the stack of sheets 120 shown in FIG. 3 as one example according to this embodiment in a case 111, as viewed from the direction of the width (the direction perpendicular to folding lines).

As shown in FIGS. 1 and 2, for example, a wet tissue 10 is an impregnated sheet of a rectangular shape having a long side M (having a length m) and a short side N (having a length n). Naturally, the wet tissue 11 can be provided in various shapes such as a square (m=n). The impregnated sheet is formed by impregnating a base sheet with impregnating liquid. The base sheet may be, for example, a sheet made of pulp, a sheet made of pulp and thermoplastic resin, or a sheet made of nonwoven fabric. The impregnating liquid may be, for example, water or water-soluble alcohol.

The stack of sheets 120 of this embodiment consists of first sheet bodies 130 and second sheet bodies 140 which are each formed by folding wet tissues 10.

As shown in FIG. 1, the first sheet body 130 is formed by folding a wet tissue 10 along a first folding line 130*b* and a second folding line 130*c* which extend parallel to the short side N (perpendicularly to the direction of the width) at a distance xa, xb from an end 130*a* on one side, along the long side M (in the direction of the width). The folding direction along the second folding line 130*c* is opposite to the folding direction along the first folding line 130*b*. For example, the end 130*a* on one side is folded upward (to one side in a direction perpendicular to the direction of the width) along the first folding line 130*b*, and the other end 130*d* is folded downward (to the other side in the direction perpendicular to the direction of the width) along the second folding line 130*c*. Thus, when viewed from the direction of the width, the first sheet body 130 is formed into a Z-shape having a first piece 131 between the one end 130*a* and the first folding line 130*b*, a second piece 132 between the first folding line 130*b* and the second folding line 130*c*, and a third piece 133 between the second folding line 130*c* and the other end 130*d*. The first sheet body 130 is further folded along an auxiliary folding line 130*e* extending parallel to the short side N (perpendicularly to the direction of the width) at a distance xc2 from the other end 130*d* along the direction of the width. In this embodiment, the folding direction along the auxiliary folding line 130*e* is opposite to the folding direction along the second folding line 130*c*. For example, the other end 130*d* is folded downward (to the other side in the direction perpendicular to the direction of the width) along the auxiliary folding line 130*e*. Thus, the third piece 133 of the first sheet body 130 is folded into a first segment 133*a* and a second segment 133*b*.

The first sheet body 130, the first piece 131 of the first sheet body 130, the second piece 132 of the first sheet body 130, the third piece 133 (the first segment 133*a* and the second segment 133*b*) of the first sheet body 130, and the second segment 133*b* of the third piece 133 of the first sheet body 130 are features that correspond to the "first sheet body", the "first piece of the first sheet body", the "second piece of the first sheet body", the "third piece of the first sheet body" and the "auxiliary piece formed by folding an end of the piece of the first sheet body which lies on one of the opposite sides in the stacking direction", respectively, according to this invention.

As shown in FIG. 2, the second sheet body 140 is formed by folding a wet tissue 10 along a folding line 140*b* which extends parallel to the short side N (perpendicularly to the direction of the width) at a distance ya from an end 140*a* on one side, along the long side M (in the direction of the width). For example, an end 140*c* of the other side is folded downward (to the other side in the direction perpendicular to the direction of the width) along the folding line 140*b*. Thus, when viewed from the direction of the width, the second sheet body 140 is formed into a V-shape having a first piece 141 between the one end 140*a* and the folding line 140*b*, and a second piece 142 between the folding line 140*b* and the other end 140*c*. The second sheet body 140 is further folded along an auxiliary folding line 140*e* extending parallel to the short side N (perpendicularly to the direction of the width) at a distance yb2 from the other end 140*c* along the direction of the width. In this embodiment, the folding direction along the auxiliary folding line 140*e* is opposite to the folding direction along the folding line 140*b*. For example, the other end 140*c* is folded downward (to the other side in the direction perpendicular to the direction of the width) along the auxiliary folding line 140*e*. Thus, the second piece 142 of the second sheet body 140 is folded into a first segment 142*a* and a second segment 142*b*.

The second sheet body 140, the first piece 141 of the second sheet body 140, the second piece 142 (the first segment 142*a* and the second segment 142*b*) of the second sheet body 140, and the second segment 142*b* of the second sheet body 140 are features that correspond to the "second sheet body", the "fourth piece of the second first sheet body", the "fifth piece of the second first sheet body", and the "auxiliary piece formed by folding the end of the piece of the second sheet body which lies on one of the opposite sides in the stacking direction", respectively, according to this invention.

Then, the first sheet bodies 130 and the second sheet bodies 140 are stacked one on another to form the stack of sheets 120. The first sheet bodies 130 and the second sheet bodies 140 are stacked one on another in such a manner that, when a first sheet body 130 or second sheet body 140 lying on the end of the stack of sheets on one side in the stacking direction (on the upper end in FIGS. 3 and 4) is pulled away from the stack of sheets 120 one by one, part of a second sheet body 140 or first sheet body 130 which immediately underlies the first sheet body 130 or second sheet body 140 is also pulled away from the stack of sheets 120.

The first sheet bodies 130 and the second sheet bodies 140 are stacked one on another, for example, in such a manner that the first piece 141 and the second piece 142 (the first segment 142*a* and the second segment 142*b*) of each of the second sheet bodies 140 are inserted between the second piece 132 and the third piece 133 (the first segment 133*a* and the second segment 133*b*) of the first sheet body 130 on one side in the stacking direction of the second sheet body 140 and between the first piece 131 and the second piece 132 of the first sheet body 130 on the other side in the stacking direction of the second sheet body 140, respectively.

FIG. 3 shows one example of the stack of sheets 120 according to this embodiment. In FIG. 3, a width m of the wet tissue 10 is 200 mm, a width L of the stack of sheets 120 is 90 mm, a width xa of the first piece 131 of the first sheet body 130 is 45 mm, a width xb of the second piece 132 is 90 mm, a width xc1 of the first segment 130*a* is 45 mm, a width xc2 of the second segment 130*b* is 20 mm (i.e. a width xc of the third piece 133 is 65 mm), a width ya of the first piece 141 of the second sheet body 140 is 90 mm, a width yb1 of the first segment 142*a* is 90 mm, a width yb2 of the second segment 142*b* is 20 mm (i.e. a width yb of the second piece 142 is 110 mm).

The first sheet bodies 130 and the second sheet bodies 140 are arranged alternately along the stacking direction (vertical direction in FIG. 3), when viewed from the direction perpendicular to the folding lines of the first and second sheet bodies 130, 140 (from the direction of the width). Further, the first sheet bodies 130 are arranged along the stacking direction in such orientation that the one ends 130*a* and the other ends 130*d* are alternately reversed in position with respect to a direction perpendicular to the stacking direction (to a lateral direction in FIG. 3). Likewise, the second sheet bodies 140 are arranged along the stacking direction in such orientation that the one ends 140*a* and the other ends 140*c* are alternately reversed in position with respect to the direction perpendicular to the stacking direction (to the lateral direction in FIG. 3).

In the following description, the first sheet bodies 130 which are arranged in one orientation with respect to the positions of the one ends 130*a* and the other ends 130*d* are designated by 130A (the first sheet bodies of a first group), while the other first sheet bodies 130 which are arranged in the other orientation (in reversed orientation to the one orientation) are designated by 130B (the first sheet bodies of a second group). In FIG. 3, the first sheet bodies 130A (the first sheet bodies of the first group) are arranged with the one ends 130*a*A on the left (on one side with respect to the direction perpendicular to the stacking direction) and the other ends 130*d*A on the right (on the other side with respect to the direction perpendicular to the stacking direction). Further, the first sheet bodies 130B (the first sheet bodies of the second group) are arranged with the one ends 130*a*B on the right (on the other side with respect to the direction perpendicular to the stacking direction) and the other ends 130*d*B on the left (on the one side with respect to the direction perpendicular to the stacking direction).

Likewise, the second sheet bodies 140 which are arranged in one orientation with respect to the positions of the one ends 140*a* and the other ends 140*c* are designated by 140A (the second sheet bodies of a first group), while the other second sheet bodies 140 which are arranged in the other orientation (in reversed orientation to the one orientation) are designated by 140B (the second sheet bodies of a second group). In FIG. 3, the second sheet bodies 140A (the second sheet bodies of the first group) are arranged with one ends 140*a*A on the right (on the other side with respect to the direction perpendicular to the stacking direction) and the other ends 140*c*A on the left (on the one side with respect to the direction perpendicular to the stacking direction). Further, the second sheet bodies 140B (the second sheet bodies of the second group) are arranged with the one ends 140*a*B on the left (on the one side with respect to the direction perpendicular to the stacking direction) and the other ends 140*c*B on the right (on the other side with respect to the direction perpendicular to the stacking direction).

The first sheet bodies 130A, 130B and the second sheet bodies 140A, 140B are stacked one on another.

In this embodiment, the first piece 141A of each of the second sheet bodies 140A is inserted between the second piece 132A and the third piece 133A (the first segment 133*a*A and the second segment 133*b*A), specifically between the second piece 132A and the first segment 133*a*A, of the first sheet body 130A on the upper side of (on one side in the stacking direction of) the second sheet body 140A. Further, the second piece 142A (the first segment 142*a*A and the second segment 142*b*A) of the second sheet body 140A is inserted between the first piece 131B and the second piece 132B of the first sheet body 130B on the lower side of (on the other side in the stacking direction of) the second sheet body 140A.

Likewise, the first piece 141B of the second sheet body 140B is inserted between the second piece 132B and the third piece 133B (the first segment 133*a*B and the second segment 133*b*B), specifically between the second piece 132B and the first segment 133*a*B, of the first sheet body 130B on the upper side of (on the one side in the stacking direction of) the second sheet body 140B. Further, the second piece 142B (the first segment 142*a*B and the second segment 142*b*B) of the second sheet body 140B is inserted between the first piece 131A and the second piece 132A of the first sheet body 130A on the lower side of (on the other side in the stacking direction of) the second sheet body 140B.

The stack of sheets 120 of this embodiment as shown in FIG. 3 is contained in a case 111 of a sheet container 110 shown in FIG. 5. A sheet take-out opening 112 is formed in the case 111. The first sheet bodies 130 (130A, 130B) and the second sheet bodies 140 (140A, 140B) which form the stack of sheets 120 are taken out through the take-out opening 2 one by one. In this embodiment, the stack of sheets 120 is contained within the case 111 with the take-out opening 112 side of the case 111 on the upper side (the one side in the stacking direction) in FIG. 3.

Taking out the first sheet bodies 130 (130A, 130B) and the second sheet bodies 140 (140A, 140B) through the take-out opening 112 of the case 111 is now described.

In order to take out the first sheet body 130A lying on the upper end (on one side in the stacking direction) of the stack of sheets 120, the one end 130*a*A side of the first sheet body 130 is pulled in an upward direction (in the direction of the one side in the stacking direction) shown by a solid arrow through the take-out opening 112 away from the stack of sheets 120. At this time, the third piece 133A of the first sheet body 130 (particularly, the first segment 133Aa of the third piece 133A, which is placed on the one side in the stacking direction) is also pulled in the upward direction shown by a dotted arrow. In this embodiment, the first piece 141A of the second sheet body 140A which immediately underlies the first sheet body 130A is inserted between the second piece 132A and the third piece 133A (particularly, the first segment 133*a*A of the third piece 133A, which is placed on the one side in the stacking direction). Therefore, when the third piece 133A of the first sheet body 130A is pulled in the upward direction shown by the dotted arrow, the first piece 141A of the second sheet body 140A is also pulled upward by friction between the first segment 133*a*A of the third piece 133A of the first sheet body 130A and the first piece 141A of the second sheet body 140A. In this case, when the first sheet bodies 130 (130A, 130B) and second sheet bodies 140 (140A, 140B) shown in FIG. 3 are used, an overlapping width w of an overlapping region W between the first segment 133*a*A of the third piece 133A of the first sheet body 130A and the first piece 141A of the second sheet body 140A is 45 mm. Therefore, friction which is related to the overlapping width w of the overlapping region W is produced between the first segment 133*a*A of the third piece 133A of the first sheet body 130A and the first piece 141A of the second sheet body 140A. Then, when the first sheet body 130A is taken out through the take-out opening 112, the one end 140*a*A side of the first piece 141A of the second sheet body 140A is partially exposed (drawn out) through the take-out opening 112.

Next, in order to take out the second sheet body 140A, the drawn-out part of the one end 140*a*A side of the first piece 141A of the second sheet body 140A is pulled in an upward direction shown by a solid arrow away from the stack of sheets 120. At this time, the second piece 142A (particularly, the first segment 142*a*A of the second piece 142A, which is placed on the one side in the stacking direction) of the second sheet body 140A is also pulled in the upward direction shown by a dotted arrow. In this embodiment, the second piece 142A (particularly, the first segment 142*a*A) of the second sheet body 140A is inserted between the first piece 131B and the second piece 132B of the first sheet body 130B. Therefore, when the second piece 142A (particularly, the first segment 142*a*A) of the second sheet body 140A is pulled in the upward direction shown by the dotted arrow, the one end 130*a*B side of the first piece 131B of the first sheet body 130B is also pulled upward by friction between the first segment 142*a*A of the second piece 142A of the second sheet body 140A and the first piece 131B of the first sheet body 130B. In this case, when the first sheet bodies 130 (130A, 130B) and second sheet bodies 140 (140A, 140B) shown in FIG. 3 are used, an overlapping width w of an overlapping region W between the first segment 142*a*A of the second piece 142A of the second sheet body 140A and the first piece 131B of the first sheet body 130B is 45 mm. Therefore, friction which is related to the overlapping width w of the overlapping region W is produced between the first segment 142*a*A of the second piece 142A of the second sheet body 140A and the first piece 131B of the first sheet body 130B. Then, when the second sheet body 140A is taken out through the take-out opening 112, the one end 130*a*B side of the first piece 131B of the first sheet body 130B is partially exposed (drawn out) through the take-out opening 112.

In the same manner, when the drawn-out part of the one end 130*a*B side of the first piece 131B of the first sheet body 130B is pulled upward, the first sheet body 130B is taken out, and at the same time, the one end 140*a*B side of the first piece 141B of the second sheet body 140B to be taken out next is partially exposed (drawn out) through the take-out opening 112. Thereafter, when the drawn-out part of the one end 140*a*B side of the first piece 141B of the second sheet body 140B is pulled upward, the second sheet body 140B is taken out, and at the same time, the one end 130*a*A side of the first piece 131A of the first sheet body 130A to be taken out next is partially exposed (drawn out) through the take-out opening 112.

When the stack of sheets 120 is formed as described above by the first sheet bodies 130 (130A, 130B) and the second sheet bodies 140 (140A, 140B) which are dimensioned as shown in FIG. 3, even if the sheet width m is 200 mm and the width L of the stack of sheets 120 is 90 mm (or even if n>2m), the overlapping width w of the overlapping region W between the first sheet body 130 (130A, 130B) and the second sheet body 140 (140A, 140B) can be set to the desired width of 45 mm.

Further, in this embodiment, the auxiliary pieces (e.g. 133*b*A and 142*b*A, 133*b*B and 142*b*B) of the first sheet body 130 and the second sheet body 140 which are adjacent to each other in the stacking direction, the auxiliary pieces (e.g. 133*b*A and 133*b*B) of the first sheet bodies 130 which are adjacent to each other in the stacking direction, and the auxiliary pieces (e.g. 142*b*A and 142*b*B) of the second sheet bodies 140 which are adjacent to each other in the stacking direction do not overlap one another. Therefore, the stack of sheets 120 can be prevented from being partially increased in height.

FIG. 4 shows another example of the stack of sheets 120 formed by using differently dimensioned first sheet bodies 130 (130A, 130B) and second sheet bodies 140 (140A, 140B).

In FIG. 4, the width m of the wet tissue 10 is 200 mm, the width L of the stack of sheets 120 is 90 mm, the width xa of the first piece 131 of the first sheet body 130 is 45 mm, the width xb of the second piece 132 is 90 mm, the width xc1 of the first segment 130*a* is 35 mm, the width xc2 of the second segment 130*b* is 30 mm (i.e. the width xc of the third piece 133 is 65 mm), the width ya of the first piece 141 of the second sheet body 140 is 90 mm, the width yb1 of the first segment 142*a* is 80 mm, the width yb2 of the second segment 142*b* is 30 mm (i.e. the width yb of the second piece 142 is 110 mm).

When the first sheet bodies 130 (130A, 130B) and the second sheet bodies 140 (140A, 140B) which are dimensioned as shown in FIG. 4 are used, the overlapping width w of the overlapping region W between the first sheet body 130 (130A, 130B) and the second sheet body 140 (140A, 140B) can be set to a desired width of 35 mm, even if the sheet width m is 200 mm and the width L of the stack of sheets 120 is 90 mm (or even if n>2m).

(Second Representative Embodiment)

Figure 6:
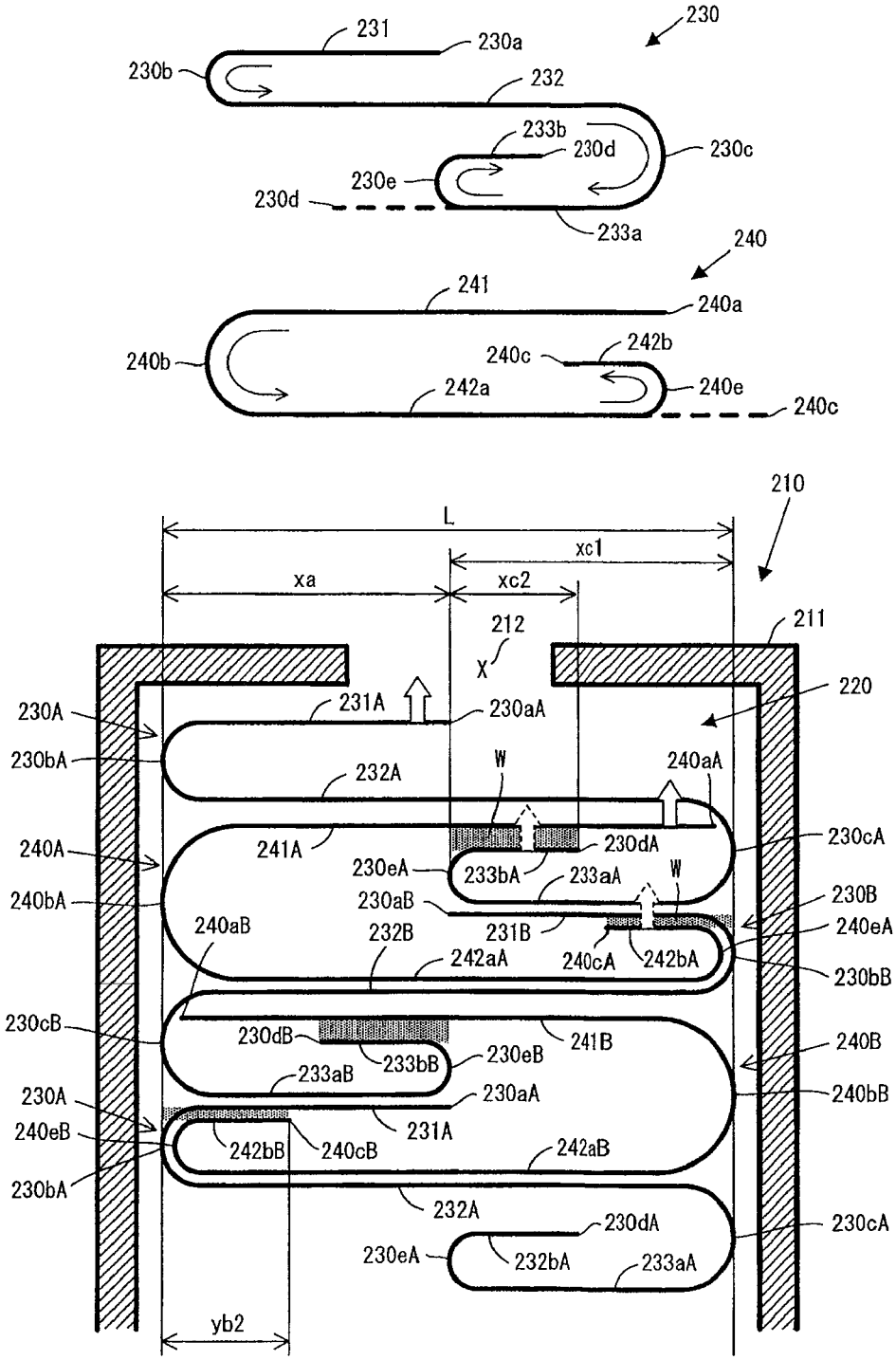
FIG. 6 shows a first sheet body and a second sheet body which form a stack of sheets according to a second embodiment of the invention, and a sheet container which contains the stack of sheets according to the second embodiment in a case.

Second representative embodiment of a stack of sheets and a sheet container according to this invention is now described with reference to FIG. 6.

A stack of sheets 220 of this embodiment is formed by first sheet bodies 230 and second sheet bodies 240.

Like the first sheet body 130 of the first embodiment, the first sheet body 230 is formed by folding a sheet along a first folding line 230*b* and a second folding line 230*c* at a distance xa, xb from an end 230*a* on one side in the direction of the width. The folding direction along the second folding line 230*c* is opposite to the folding direction along the first folding line 230*b*. Thus, the first sheet body 230 is formed into a Z-shape having a first piece 231, a second piece 232 and a third piece 233. The first sheet body 230 is further folded along an auxiliary folding line 230*e* at a distance xc2 from the other end 230*d* along the direction of the width. In this embodiment, the folding direction along the auxiliary folding line 230*e* is the same as the folding direction along the second folding line 230*c*. For example, the other end 230*d* is folded upward (to the one side in the direction perpendicular to the direction of the width) along the auxiliary folding line 230*e*. Thus, the third piece 233 of the first sheet body 230 is folded into a first segment 233*a* and a second segment 233*b*.

Like the second sheet body 140 of the first embodiment, the second sheet body 240 is folded along a folding line 240*b* at a distance ya from an end 240*a* on one side in the direction of the width. Thus, the second sheet body 240 is formed into a V-shape having a first piece 241 and a second piece 242. The second sheet body 240 is further folded along an auxiliary folding line 240*e* at a distance yb2 from the other end 240*c* along the direction of the width. In this embodiment, the folding direction along the auxiliary folding line 240*e* is the same as the folding direction along the folding line 240*b*. For example, the other end 240*c* is folded upward (to the one side in the direction perpendicular to the direction of the width) along the auxiliary folding line 240*e*. Thus, the second piece 242 of the second sheet body 240 is folded into a first segment 242*a* and a second segment 242*b*.

Then, like in the first embodiment, the first sheet bodies 230 and the second sheet bodies 240 are stacked one on another in such a manner that the first piece 241 and the second piece 242 (the first segment 242*a* and the second segment 242*b*) of each of the second sheet bodies 240 are inserted between the second piece 232 and the third piece 233 (the first segment 233*a* and the second segment 233*b*) of the first sheet body 230 on one side in the stacking direction of the second sheet body 240 and between the first piece 231 and the second piece 232 of the first sheet body 230 on the other side in the stacking direction of the second sheet body 240, respectively.

In this embodiment, when a first sheet body 230A (230B) is taken out of a case 211 through a take-out opening 212, one end 240*a*A (240*a*B) side of a first piece 241A (241B) of a second sheet body 240A (240B) is partially exposed through the take-out opening 212 by friction between a second segment 233*b*A (233*b*B) of a third piece 233A (233B) of the first sheet body 230A (230B) and a first piece 241A (241B) of the second sheet body 240A (240B).

Further, when the second sheet body 240A (240B) is taken out of the case 211 through the take-out opening 212, one end 230*a*B (230*a*A) side of a first piece 231B (231A) of the first sheet body 230B (230A) is partially exposed through the take-out opening 212 by friction between a second segment 242*b*A (242*b*B) of a second piece 242A (242B) of the second sheet body 240A (240B) and a first piece 231B (231A) of the first sheet body 230B (230A).

In this embodiment, too, the overlapping width w of the overlapping region W between the first sheet body 230 and the second sheet body 240 can be reduced by adjusting the length of the second segment 233*b* (on the other end 230*d* side) of the third piece 233 of the first sheet body 230 and the length of the second segment 242*b* (on the other end 240*c* side) of the second piece 242 of the second sheet body 240.

Further, the auxiliary pieces (e.g. 242*b*A and 232*b*A, 242*b*B and 232*b*B) of the first sheet body 230 and the second sheet body 240 which are adjacent to each other in the stacking direction, the auxiliary pieces (e.g. 242*b*A and 232*b*B) of the first sheet bodies 230 which are adjacent to each other in the stacking direction, and the auxiliary pieces (e.g. 232*b*A and 232*b*B) of the second sheet bodies 240 which are adjacent to each other in the stacking direction do not overlap one another. Therefore, the stack of sheets 220 can be prevented from being partially increased in height.

(Third Representative Embodiment)

Figure 7:
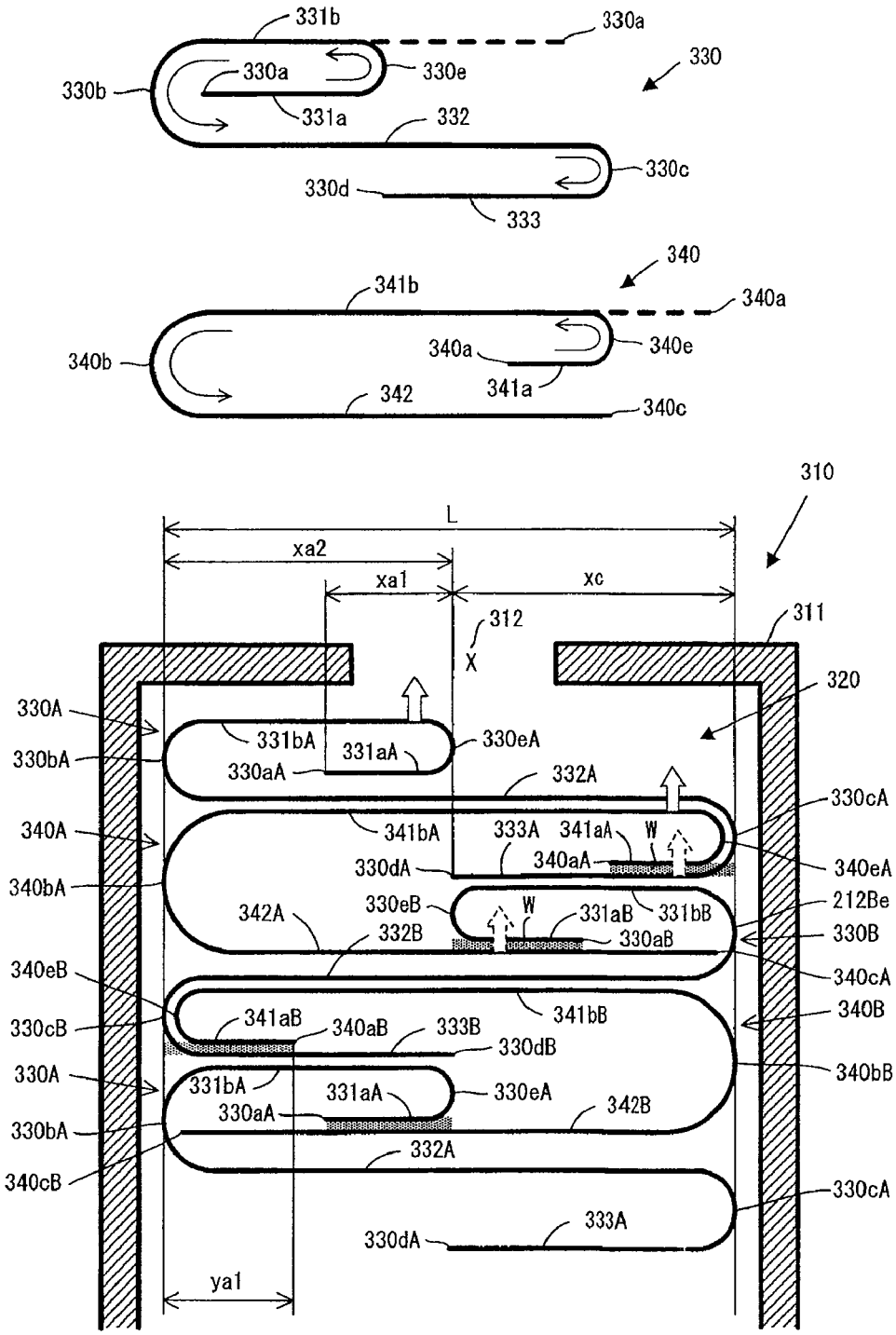
FIG. 7 shows a first sheet body and a second sheet body which form a stack of sheets according to a third embodiment of the invention, and a sheet container which contains the stack of sheets according to the third embodiment in a case.

Third representative embodiment of a stack of sheets and a sheet container according to this invention is now described with reference to FIG. 7.

A first sheet body 330 is folded along a first folding line 330*b* and a second folding line 330*c* which extend parallel to a short side N (perpendicularly to the direction of the width) at a distance xa, xb from an end 330*a* on one side in the direction of the width of the wet tissue 10. The folding direction along the second folding line 330*c* is opposite to the folding direction along the first folding line 330*b*. For example, the one end 330*a* is folded upward (to one side in a direction perpendicular to the direction of the width) along the first folding line 330*b*, and the other end 330*d* is folded downward (to the other side in the direction perpendicular to the direction of the width) along the second folding line 330*c*. Thus, the first sheet body 330 is formed into a Z-shape having a first piece 331, a second piece 332 and a third piece 333. The first sheet body 330 is further folded along an auxiliary folding line 330*e* extending perpendicularly to the direction of the width at a distance xa1 from the one end 330*a* along the direction of the width of the wet tissue 10. In this embodiment, the folding direction along the auxiliary folding line 330*e* is the same as the folding direction along the first folding line 330*b*. For example, the one end 330*a* is folded downward (to the other side in the direction perpendicular to the direction of the width) along the auxiliary folding line 330*e*. Thus, the first piece 331 of the first sheet body 330 is folded into a first segment 331*a* and a second segment 331*b*.

The first sheet body 330, the first piece 331 (the first segment 331*a* and the second segment 331*b*) of the first sheet body 330, the second piece 332 of the first sheet body 330, the third piece 333 of the first sheet body 330, and the first segment 331*a* of the first piece 331 of the first sheet body 330 are features that correspond to the "first sheet body", the "first piece of the first sheet body", the "second piece of the first sheet body", the "third piece of the first sheet body" and the "auxiliary piece formed by folding the end of the piece of the first sheet body which lies on one of the opposite sides in the stacking direction", respectively, according to this invention.

A second sheet body 340 is folded along a folding line 340*b* extending perpendicularly to the direction of the width at a distance ya from an end 340*a* on one side in the direction of the width of the wet tissue 10. Thus, the second sheet body 340 is formed into a V-shape having a first piece 341 and a second piece 342. The second sheet body 340 is further folded along an auxiliary folding line 340*e* extending perpendicularly to the direction of the width at a distance yb1 from the one end 340*a* along the direction of the width. In this embodiment, the folding direction along the auxiliary folding line 340*e* is opposite to the folding direction along the folding line 340*b*. For example, the other end 340*c* is folded downward (to the other side in the direction perpendicular to the direction of the width) along the auxiliary folding line 340*e*. Thus, the first piece 341 of the second sheet body 340 is folded into a first segment 341*a* and a second segment 341*b*.

The second sheet body 340, the first piece 341 (the first segment 341*a* and the second segment 341*b*) of the second sheet body 340, the second piece 342 of the second sheet body 340, and the first segment 341*b* of the second sheet body 340 are features that correspond to the "second sheet body", the "fourth piece of the second first sheet body", the "fifth piece of the second first sheet body", and the "auxiliary piece formed by folding the end of the piece of the second sheet body which lies on one of the opposite sides in the stacking direction", respectively, according to this invention.

Then, like in the first embodiment, the first sheet bodies 330 and the second sheet bodies 340 are stacked one on another in such a manner that the first piece 341 (the first segment 341*a* and the second segment 341*b*) and the second piece 242 of each of the second sheet bodies 340 are inserted between the second piece 332 and the third piece 333 of the first sheet body 330 on one side in the stacking direction of the second sheet body 340 and between the first piece 331 (the first segment 331*a* and the second segment 331*b*) and the second piece 232 of the first sheet body 330 on the other side in the stacking direction of the second sheet body 340, respectively.

In this embodiment, when a first sheet body 330A (330B) is taken out of a case 311 through a take-out opening 312, a first segment 341*a*A (341*a*B) of a first piece 341A (341B) of a second sheet body 340A (340B) is exposed through the take-out opening 312 by friction between a third piece 333A (333B) of the first sheet body 330A (330B) and a first segment 341*a*A (341*a*B) of a first piece 341A (341B) of the second sheet body 340A (340B).

Further, when the second sheet body 340A (340B) is taken out of the case 311 through the take-out opening 312, a first segment 331*a*B (331*a*A) of a first piece 331B (331A) of the first sheet body 330B (330A) is exposed through the take-out opening 312 by friction between a second piece 342A (342B) of the second sheet body 340A (340B) and a first segment 331*a*B (331*a*A) of a first piece 331B (331A) of the first sheet body 330A (330B).

In this embodiment, too, the overlapping width w of the overlapping region W between the first sheet body 330 and the second sheet body 340 can be reduced by adjusting the length of the first segment (auxiliary piece) 331*a* of the first piece 331 of the first sheet body 330 and the length of the second segment (auxiliary piece) 242*b* of the second piece 342 of the second sheet body 340.

Further, the auxiliary pieces (e.g. 331*a*B and 341*a*A, 331*a*A and 341*a*B) of the first sheet body 330 and the second sheet body 340 which are adjacent to each other in the stacking direction, the auxiliary pieces (e.g. 341*a*A and 341*a*B) of the first sheet bodies 330 which are adjacent to each other in the stacking direction, and the auxiliary pieces (e.g. 331*a*B and 331*a*A) of the second sheet bodies 340 which are adjacent to each other in the stacking direction do not overlap one another. Therefore, the stack of sheets 320 can be prevented from being partially increased in height.

(Fourth Representative Embodiment)

Figure 8:
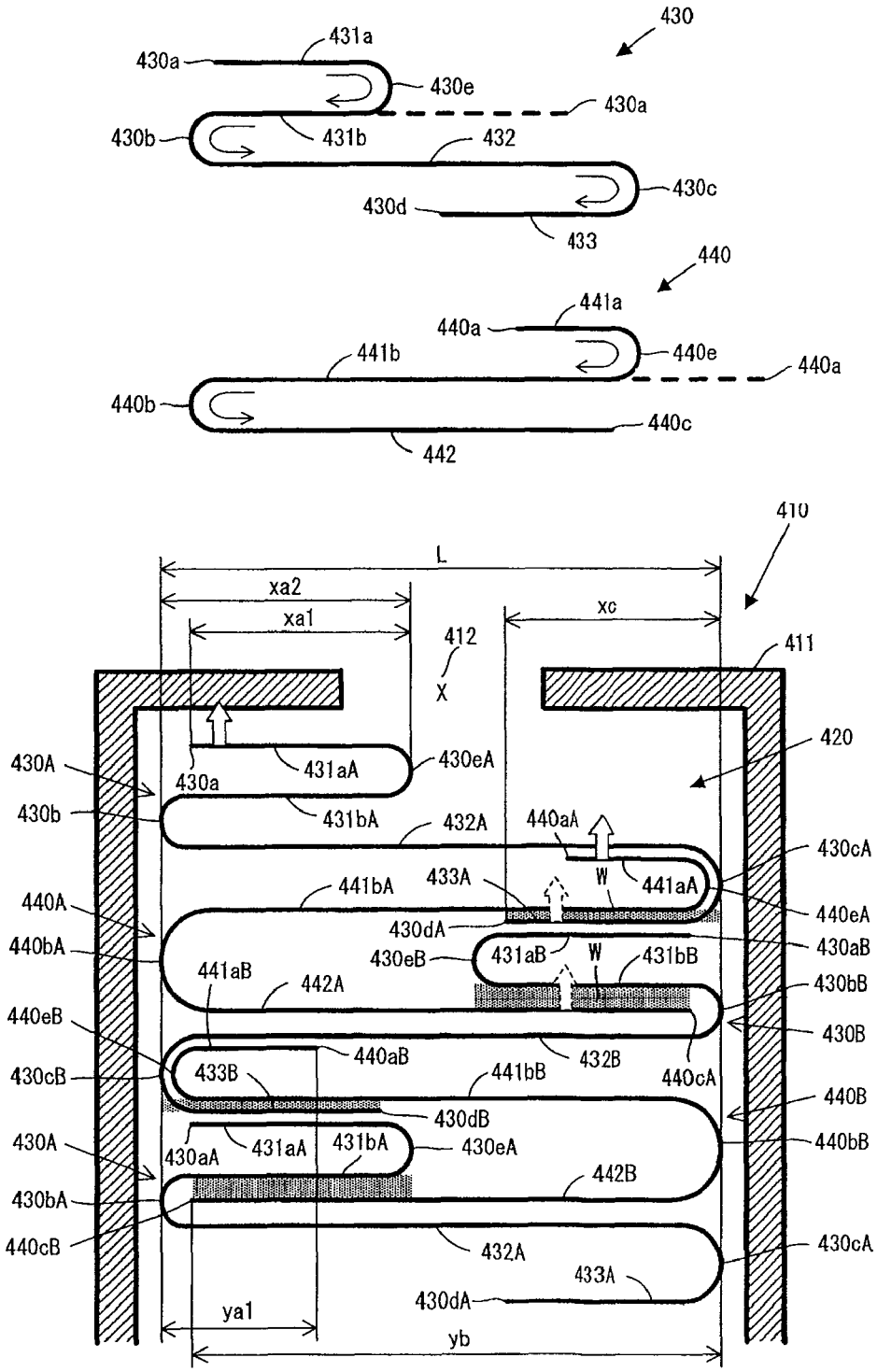
FIG. 8 shows a first sheet body and a second sheet body which form a stack of sheets according to a fourth embodiment of the invention, and a sheet container which contains the stack of sheets according to the fourth embodiment in a case.

Fourth representative embodiment of a stack of sheets and a sheet container according to this invention is now described with reference to FIG. 8.

Like the first sheet body 330 in the third embodiment, a first sheet body 430 is folded along a first folding line 430*b* and a second folding line 430*c* at a distance xa, xb from an end 430*a* on one side in the direction of the width. The folding direction along the second folding line 430*c* is opposite to the folding direction along the first folding line 430*b*. Thus, the first sheet body 430 is formed into a Z-shape having a first piece 431, a second piece 432 and a third piece 433. The first sheet body 430 is further folded along an auxiliary folding line 430*e* at a distance xa1 from the one end 430*a* along the direction of the width. In this embodiment, the folding direction along the auxiliary folding line 430*e* is opposite to the folding direction along the first folding line 430*b*. For example, the one end 430*a* is folded upward (to the one side in the direction perpendicular to the direction of the width) along the auxiliary folding line 430*e*. Thus, the first piece 431 of the first sheet body 430 is folded into a first segment 431*a* and a second segment 431*b*.

Like the second sheet body 340 in the third embodiment, a second sheet body 440 is folded along a folding line 440*b* at a distance ya from an end 440*a* on one side in the direction of the width. Thus, the second sheet body 440 is formed into a V-shape having a first piece 441 and a second piece 442. The second sheet body 440 is further folded along an auxiliary folding line 440*e* at a distance yb1 from the one end 440*a* along the direction of the width. In this embodiment, the folding direction along the auxiliary folding line 440*e* is opposite to the folding direction along the folding line 440*b*. For example, the one end 440*a* is folded upward (to the one side in the direction perpendicular to the direction of the width) along the auxiliary folding line 440*e*. Thus, the first piece 441 of the second sheet body 440 is folded into a first segment 441*a* and a second segment 441*b*.

Then, like in the third embodiment, the first sheet bodies 430 and the second sheet bodies 440 are stacked one on another in such a manner that the first piece 441 (the first segment 441*a* and the second segment 441*b*) and the second piece 442 of each of the second sheet bodies 440 are inserted between the second piece 432 and the third piece 433 of the first sheet body 430 on one side in the stacking direction of the second sheet body 440 and between the first piece 431 (the first segment 431*a* and the second segment 431*b*) and the second piece 432 of the first sheet body 430 on the other side in the stacking direction of the second sheet body 440, respectively.

In this embodiment, when a first sheet body 430A (430B) is taken out of a case 411 through a take-out opening 412, one end 440*a*A (440*a*B) side of a second segment 441*b*A (441*b*B) of a first piece 441A (441B) of a second sheet body 440A (440B) is partially exposed through the take-out opening 412 by friction between a third piece 433A (433B) of the first sheet body 430A (430B) and a second segment 441*b*A (441*b*B) of a first piece 441A (441B) of the first sheet body 430A (430B).

Further, when the second sheet body 440A (440B) is taken out of the case 411 through the take-out opening 412, a second segment 431*b*B (431*b*A) of a first piece 431B (431A) of the first sheet body 430B (430A) is exposed through the take-out opening 412 by friction between a second segment 442*b*A (442*b*B) of a second piece 442A (442B) of the second sheet body 440A (440B) and a second segment 431*b*B (431*b*A) of a first piece 431B (431A) of the first sheet body 430A (430B).

In this embodiment, too, the overlapping width w of the overlapping region W between the first sheet body 430 and the second sheet body 440 can be reduced by adjusting the length of the first segment 431*a* (on the one end 430*a* side) of the first piece 431 of the first sheet body 430 and the length of the first segment 441*a* (on the one end 440*a* side) of the first piece 441 of the second sheet body 440.

(Fifth Representative Embodiment)

Figure 9:
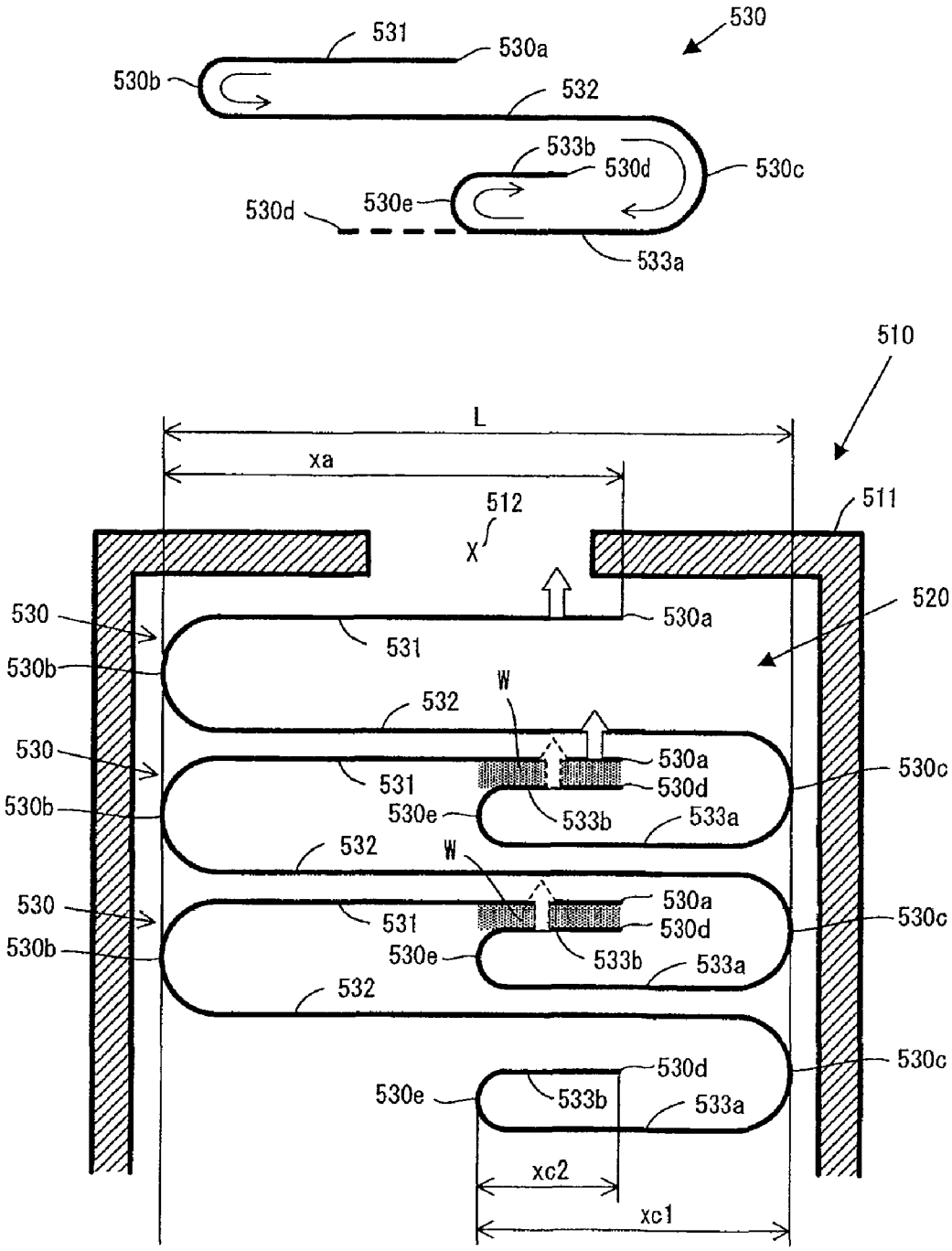
FIG. 9 shows a sheet body which forms a stack of sheets according to a fifth embodiment of the invention, and a sheet container which contains the stack of sheets according to the fifth embodiment in a case.

Fifth representative embodiment of a stack of sheets and a sheet container according to this invention is now described with reference to FIG. 9.

In this embodiment, the stack of sheets is formed only by sheet bodies 530. Each of the sheet bodies 530 is folded along a first folding line 530*b* and a second folding line 530*c* which extend perpendicularly to the direction of the width at a distance xa, xb from an end 530*a* on one side in the direction of the width of the wet tissue 10. The folding direction along the second folding line 530*c* is the same as the folding direction along the first folding line 530*b*. For example, the one end 530*a* is folded upward (to one side in a direction perpendicular to the direction of the width) along the first folding line 530*b*, and the other end 530*d* is folded downward (to the other side in the direction perpendicular to the direction of the width) along the second folding line 530*c*. Thus, the sheet body 530 is formed into a Z-shape having a first piece 531, a second piece 532 and a third piece 533. The sheet body 530 is further folded along an auxiliary folding line 530*e* extending perpendicularly to the direction of the width at a distance xc2 from the other end 530*d* along the direction of the width. In this embodiment, the folding direction along the auxiliary folding line 530*e* is opposite to the folding direction along the second folding line 530*c*. For example, the other end 530*d* is folded downward (to the other side in the direction perpendicular to the direction of the width) along the auxiliary folding line 530*e*. Thus, the third piece 533 of the sheet body 530 is folded into a first segment 533*a* and a second segment 533*b*.

Then, the sheet bodies 530 are stacked one on another in such a manner that the first piece 531 of each of the sheet bodies 530 is inserted between the second piece 532 and the third piece 533 (the first segment 533*a* and the second segment 533*b*) of the other sheet body 530 on one side in the stacking direction of the sheet body 530.

In this embodiment, when the sheet body 530 is taken out of a case 511 through a take-out opening 512, one end 530*a* side of the first piece 531 of the sheet body 530 is partially exposed through the take-out opening 512 by friction between the third piece 533 (particularly, the second segment 533*b*) of the sheet body 530 to be taken out and the first piece 532 of the other sheet body 530.

In this embodiment, too, the overlapping width w of the overlapping region W between the sheet bodies 530 can be reduced by adjusting the length of the second segment 533*b* (on the other end 530*d* side) of the third piece 533 of the sheet body 530.

(Sixth Representative Embodiment)

Figure 10:
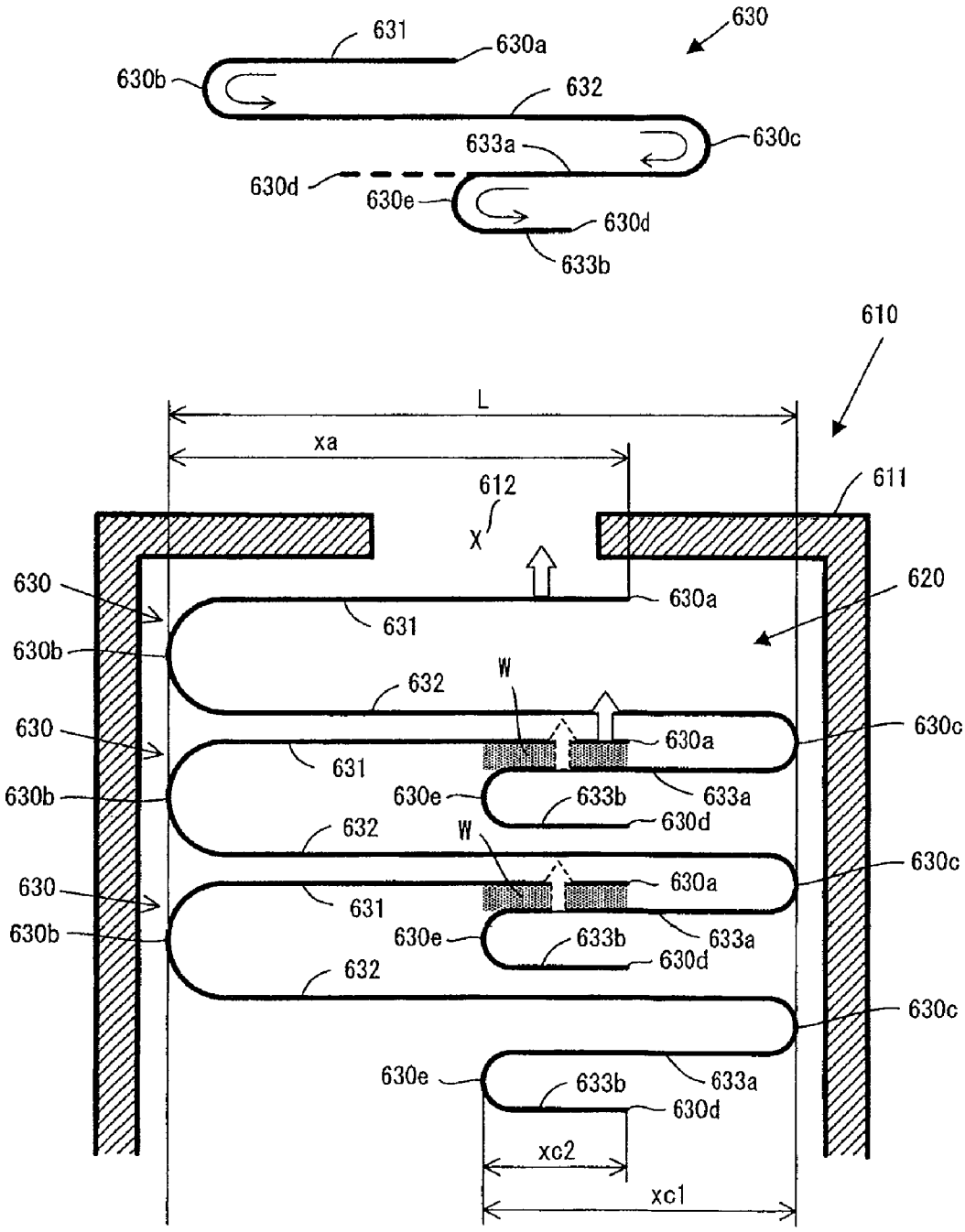
FIG. 10 shows a sheet body which forms a stack of sheets according to a sixth embodiment of the invention, and a sheet container which contains the stack of sheets according to the sixth embodiment in a case.

Sixth representative embodiment of a stack of sheets and a sheet container according to this invention is now described with reference to FIG. 10.

In this embodiment, like in the fifth embodiment, the stack of sheets is formed only by sheet bodies 630 each of which is formed into a Z-shape having a first piece 631, a second piece 632 and a third piece 633. The sheet body 630 is further folded along an auxiliary folding line 630*e* extending perpendicularly to the direction of the width at a distance xc2 from an end 630*d* on the other side along the direction of the width. In this embodiment, the folding direction along the auxiliary folding line 630*e* is opposite to the folding direction along a second folding line 630*c*. For example, the other end 630*d* is folded downward (to the other side in the direction perpendicular to the direction of the width) along the auxiliary folding line 630*e*. Thus, the third piece 633 of the sheet body 630 is folded into a first segment 633*a* and a second segment 633*b*.

Then, like in the fifth embodiment, the sheet bodies 630 are stacked one on another in such a manner that the first piece 631 of each of the sheet bodies 630 is inserted between the second piece 632 and the third piece 633 (the first segment 633*a* and the second segment 633*b*) of the other sheet body 630 on one side in the stacking direction of the sheet body 630.

In this embodiment, when the sheet body 630 is taken out of a case 611 through a take-out opening 612, one end 630*a* side of the first piece 631 of the sheet body 630 is partially exposed through the take-out opening 612 by friction between the third piece 633 (particularly, the first segment 633*a*) of the sheet body 630 to be taken out and the first piece 632 of the other sheet body 630.

In this embodiment, too, the overlapping width w of the overlapping region W between the sheet bodies 630 can be reduced by adjusting the length of the second segment 633*b* (on the other end 630*d* side) of the third piece 633 of the sheet body 630.

In the fifth and six embodiments, the third piece 533, 633 of the sheet body 530, 630 is folded into the first and second segments (an auxiliary piece is formed by folding the other end). However, alternatively, the first piece may be folded into the first and second segments (an auxiliary piece is formed by folding the one end). In this case, too, the overlapping width of the overlapping region between the sheet bodies can be reduced by adjusting the length of the first segment (auxiliary piece) of the first piece of the sheet body.

Further, in the above-described embodiments, Z-shaped or V-shaped sheet bodies are stacked one on another to form a stack of sheets, but the shape of the sheet bodies can be appropriately selected.

As described above, in this invention, when a plurality of sheet bodies of one or more kinds each formed by folding a sheet are stacked one on another in order to form a stack of sheets, an auxiliary piece (segment) is formed by folding an end of the piece of the sheet body which lies on one of the opposite sides in the stacking direction. Friction in the overlapping region between the sheet bodies can be reduced by adjusting the length of the auxiliary piece, so that the sheets can be taken out with stability. In this case, by folding the end of the piece to form the auxiliary piece, a gap is created on the side of the end. As a result, liquid membrane (e.g. water membrane) with which the sheet bodies (sheets) lying on the both sides of the gap in the stacking direction are impregnated is destroyed, so that adhesion between the sheet bodies via the liquid membrane is deteriorated. Therefore, the sheet bodies can be prevented from being drawn out together with a sheet to be taken out next. Further, the technique of the invention is particularly effective in reducing the width L of the stack of sheets to half of the width in of the sheets or smaller.

The invention is not limited to the constructions of the above-described embodiments, but rather, may be added to, changed, replaced with alternatives or otherwise modified.

In the above embodiment, a technique of stacking wet tissues one on another is described, but the technique described herein can be applied to stacking of various kinds of sheets.

The sheet bodies for forming a stack of sheets can have various shapes which allow a sheet lying on the end on one side of the stack of sheets to be taken out continuously one by one.

Further, also with a construction in which the auxiliary sheets of sheet bodies adjacent to each other in the stacking direction (e.g. the auxiliary sheets of the first and second sheet bodies) do not overlap one another in the stacking direction, the stack of sheets can be prevented from being partially increased in height.

Each of the constructions described in the above embodiment can be used by itself or in combination of appropriately selected ones of the constructions.

Description of Numerals

10 wet tissue (sheet)

130, 130A, 130B, 230A, 230B, 330A, 330B, 430A, 430B first sheet body

140, 140A, 140B, 240A, 240B, 340A, 340B, 440A, 440B second sheet body

130*a*, 130*d*, 130*a*A, 130*d*A, 130*a*B, 130*d*B, 140*a*, 140*c*, 140*a*A, 140*c*A, 140*a*B, 140*c*B, 230*a*, 230*d*, 230*a*A, 230*d*A, 230*a*B, 230*d*B, 240*a*, 240*c*, 240*a*A, 240*c*A, 240*a*B, 240*c*B, 330*a*, 330*d*, 330*a*A, 330*d*A, 330*a*B, 330*d*B, 340*a*, 340*c*, 340*a*A, 340*c*A, 340*a*B, 340*c*B, 430*a*, 430*d*, 430*a*A, 430*d*A, 430*a*B, 430*d*B, 440*a*, 440*c*, 440*a*A, 440*c*A, 440*a*B, 440*c*B end

130*b*, 130*c*, 130*e*, 130*b*A, 130*c*A, 130*e*A, 130*b*B, 130*c*B, 130*e*B, 140*b*, 140*e*, 140*b*A, 140*e*A, 140*b*B, 140*e*B, 230*b*, 230*c*, 230*e*, 230*b*A, 230*c*A, 230*e*A, 230*a*B, 230*b*B, 230*c*B, 230*e*B, 240*b*, 240*e*, 240*b*A, 240*e*A, 240*b*B, 240*e*B, 330*b*, 330*c*, 330*e*, 330*b*A, 330*c*A, 330*e*A, 330*b*B, 330*c*B, 330*e*B, 340*b*, 340*e*, 340*b*A, 340*e*A, 340*b*B, 340*e*B, 430*b*, 430*c*, 430*e*, 430*b*A, 430*c*A, 430*e*A, 430*b*B, 430*c*B, 440*e*B, 440*b*, 440*e*, 440*b*A, 440*e*A, 440*b*B, 440*e*B, 530*b*, 530*c*, 530*e*, 630*b*, 630*c*, 630*e* folding line

110, 210, 310, 410, 510, 610 sheet container

111, 211, 311, 411, 511, 611 case

112, 212, 312, 412, 512, 612 take-out opening

530, 630 sheet body m width of a sheet

L width of a stack of sheets

The invention claimed is:

1. A stack of sheets comprising:

first wet tissue bodies each formed by folding a wet tissue, and having a first piece, a second piece and a third piece between both ends of the wet tissue body, the first piece and the third piece being folded in opposite directions to each other with respect to the second piece, second wet tissue bodies each formed by folding a wet tissue, and having a fourth piece and a fifth piece between both ends of the wet tissue body, the first wet tissue bodies and the second wet tissue bodies being alternately stacked one on another in such a manner that the fourth piece and the fifth piece of each of the second wet tissue bodies are inserted between the second piece and the third piece of a first wet tissue body adjacent to the second wet tissue body on one side in a stacking direction and between the first piece and the second piece of a first wet tissue body which is adjacent to the second wet tissue body on the other side in the stacking direction, respectively, wherein:

an auxiliary piece is formed by folding an end of the piece of each of the first and second wet tissue bodies which lies on one of the opposite sides in the stacking direction, and the auxiliary pieces of the sheet bodies adjacent in the stacking direction do not overlap one another in the stacking direction.

2. The stack of sheets as defined in claim 1, wherein the auxiliary pieces of the first sheet bodies which are adjacent in the stacking direction or the auxiliary pieces of the second sheet bodies which are adjacent in the stacking direction do not overlap one another in the stacking direction.

3. A sheet container comprising a case with a take-out opening and a stack of sheets which is formed by stacking a plurality of sheets one on another and contained within the case, and from which sheets forming the stack of sheets are taken out one by one through the take-out opening of the case, wherein:

the stack of sheets as defined in claim 1 is used as the stack of sheets.

4. A stack of wet tissue bodies comprising:

first folded wet tissue bodies each having a first piece, a second piece and a third piece between both ends of the first wet tissue body, the first piece and the third piece being folded with respect to the second piece in opposite directions to each other, second folded wet tissue bodies each having a fourth piece and a fifth piece between both ends of the second wet tissue body, the first wet tissue bodies and the second wet tissue bodies being alternately stacked one on another in such a manner that the fourth piece of each of the second wet tissue bodies is inserted between the second piece and the third piece of a first wet tissue body adjacent to the second wet tissue body on a first side in a stacking direction, and the fifth piece of each of the second wet tissue bodies is inserted between the first piece and the second piece of a first wet tissue body which is adjacent to the second wet tissue body on a second opposite side in the stacking direction, wherein each of the first wet tissue bodies further has an auxiliary piece which is an end defined by folding the third piece of the first wet tissue body, each of the second wet tissue bodies further has an auxiliary piece which is an end defined by folding the fifth piece of the second wet tissue body.

5. A stack of wet tissue bodies according to claim 4, wherein the auxiliary pieces of the first wet tissue bodies which are adjacent in the stacking direction do not overlap the auxiliary pieces of the second wet tissue bodies which are adjacent in the stacking direction in the stacking direction.

6. A stack of wet tissue bodies according to claim 4, wherein each of the first wet tissue bodies is folded differently from each of the second wet tissue bodies.

7. A stack of wet tissue bodies according to claim 6, wherein each of the first wet tissue bodies has three folds defined by the first and second pieces, the second and third pieces, and the third piece and the corresponding auxiliary piece.

8. A stack of wet tissue bodies according to claim 7, wherein each of the second wet tissue bodies has two folds defined by the fourth and fifth pieces, and the fifth piece and the corresponding auxiliary piece.

9. A stack of wet tissue bodies according to claim 4, wherein the third piece of each first wet tissue body is folded outwardly to define the corresponding auxiliary piece of the first wet tissue body, and the fifth piece of each second wet tissue body is folded inwardly to define the corresponding auxiliary piece of the second wet tissue body.

10. A stack of wet tissue bodies according to claim 4, wherein the fourth piece of each second wet tissue body and the third piece of the first wet tissue body adjacent the second wet tissue body on the first side in the stacking direction overlap each other in a first overlapping area, and the fifth piece of each second wet tissue body and the first piece of the first wet tissue body adjacent the second wet tissue body on the second side in the stacking direction overlap each other in a second overlapping area.

11. A stack of wet tissue bodies according to claim 10, wherein the first and second overlapping areas overlap each other in the stacking direction.

12. A stack of wet tissue bodies according to claim 4, wherein the fourth piece and the fifth piece excluding the corresponding auxiliary piece of each of the second wet tissue bodies have a substantially same length.

13. A stack of wet tissue bodies according to claim 4, wherein a length of the fourth piece of each of the second wet tissue bodies is greater than a length of the fifth piece excluding the corresponding auxiliary piece of the second wet tissue body.

14. A stack of wet tissue bodies according to claim 4, wherein the auxiliary piece of each of the first wet tissue bodies is between the second piece and a remaining portion of the third piece, and the auxiliary piece of each of the second wet tissue bodies is between the fourth piece and a remaining portion of the fifth piece.

15. A stack of wet tissue bodies according to claim 4, wherein the fourth piece of each second wet tissue body and the auxiliary piece of the first wet tissue body adjacent the second wet tissue body on the first side in the stacking direction overlap each other in a first overlapping area, and the auxiliary piece of each second wet tissue body and the first piece of the first wet tissue body adjacent the second wet tissue body on the second side in the stacking direction overlap each other in a second overlapping area.

16. A stack of wet tissue bodies according to claim 15, wherein the overlapping areas do not overlap each other in the stacking direction.

17. A stack of wet tissue bodies comprising:

first folded wet tissue bodies each having a first piece, a second piece and a third piece between both ends of the first wet tissue body, the first piece and the third piece being folded with respect to the second piece in opposite directions to each other, second folded wet tissue bodies each having a fourth piece and a fifth piece between both ends of the second wet tissue body, the first wet tissue bodies and the second wet tissue bodies being alternately stacked one on another in such a manner that the fourth piece of each of the second wet tissue bodies is inserted between the second piece and the third piece of a first wet tissue body adjacent to the second wet tissue body on a first side in a stacking direction, and the fifth piece of each of the second wet tissue bodies is inserted between the first piece and the second piece of a first wet tissue body which is adjacent to the second wet tissue body on a second opposite side in the stacking direction, wherein each of the first wet tissue bodies further has an auxiliary piece which is an end defined by folding the first piece of the first wet tissue body, and each of the second wet tissue bodies further has an auxiliary piece which is an end defined by folding the fourth piece of the second wet tissue body.

18. A stack of the sheets according to claim 17, wherein each of the first wet tissue bodies includes three folds defined by the auxiliary piece and a remaining portion of the first piece, the remaining portion of the first piece and the second piece, and the second piece and the third piece of the first wet tissue body, and each of the second wet tissue bodies includes two folds defined by the auxiliary piece and a remaining portion of the fourth piece, and the remaining portion of the fourth piece and the fifth piece of the second wet tissue body.

19. A stack of wet tissue bodies according to claim 18, wherein the auxiliary piece of each first wet tissue body being between the remaining portion of the first piece and the second piece of the first wet tissue body, and the auxiliary piece of each second wet tissue body being between the remaining portion of the fourth piece and the fifth piece of the second wet tissue body.

20. A stack of sheets according to claim 18, wherein the remaining portion of the first piece of each first wet tissue body is between the auxiliary piece of first wet tissue body and the second piece of the first wet tissue body, and the remaining portion of the fourth piece of each second wet tissue body is between the auxiliary piece of the second wet tissue body and the fifth piece of the second wet tissue body.

* * * * *